US011344789B1

(12) United States Patent
Mielke

(10) Patent No.: US 11,344,789 B1
(45) Date of Patent: May 31, 2022

(54) FLOOR BRACE FOR TYING CHILDREN'S ICE SKATES

(71) Applicant: Joriah Mielke, Longmont, CO (US)

(72) Inventor: Joriah Mielke, Longmont, CO (US)

( * ) Notice: Subject to any disclaimer, the term of this patent is extended or adjusted under 35 U.S.C. 154(b) by 0 days.

(21) Appl. No.: 17/148,561

(22) Filed: Jan. 14, 2021

(51) Int. Cl.
*A63C 3/06* (2006.01)
*A63C 3/10* (2006.01)

(52) U.S. Cl.
CPC . *A63C 3/06* (2013.01); *A63C 3/10* (2013.01)

(58) Field of Classification Search
CPC ..... A63C 3/06; A63C 3/10
USPC ..... 280/809, 811
See application file for complete search history.

(56) References Cited

U.S. PATENT DOCUMENTS 2,828,967 A * 4/1958 Vassanelli ..... A63C 3/12 280/825
4,021,054 A * 5/1977 Csutor ..... A63B 22/14 280/825
5,167,170 A * 12/1992 Croteau ..... A63C 3/10 206/315.1
5,189,845 A * 3/1993 Courchesne ..... A63C 3/10 451/552
5,195,277 A * 3/1993 Courchesne ..... A63C 3/10 451/45
D356,991 S * 4/1995 Wooten ..... D12/413
D368,403 S * 4/1996 Michalk ..... D6/552
5,573,275 A * 11/1996 Smith ..... A63C 17/002 280/811
6,193,082 B1 * 2/2001 Bartle ..... A47B 81/00 211/37
6,193,277 B1 * 2/2001 Marasco ..... A63C 17/002 280/809
6,312,017 B1 * 11/2001 Hardwick ..... A63C 3/10 280/811
6,595,480 B1 * 7/2003 Orlick ..... A63B 71/0036 248/346.01
7,918,035 B1 * 4/2011 Jarczewski ..... A63C 3/10 33/535
2014/0001740 A1 * 1/2014 Earle ..... A63C 3/06 280/809

* cited by examiner

*Primary Examiner* — Jeffrey J Restifo
(74) *Attorney, Agent, or Firm* — Will Hunziker

(57) ABSTRACT

A floor brace for tying children's ice skates that threads between the boot and blade of a child's ice skate and allows an adult to stand on either side of the brace holding the skate down while they pull the laces forcefully upward. The brace has an ice skate receiver sized to fit the most common skate blade sizes; alternate embodiments have multiple receivers sized to fit multiple sized skate blade sizes. The brace may also have a skate sharpener and honing stone.

13 Claims, 3 Drawing Sheets

FLOOR BRACE FOR TYING CHILDREN'S ICE SKATES

BACKGROUND OF THE INVENTION

1. Field of the Invention

The present invention is in the technical field of skates; particularly, the present invention pertains to the field of a brace for holding either ice skates down for children while tightening their laces.

2. Description of Related Art

Anybody who has kids that ice skate are aware of the importance and difficulty tying their laces tightly; invariably, their light legs, lack of muscle strength, and short attention span conspire to prevent them from holding their legs down with the force required to counteract the great upward force needed to pull and tie their laces tightly. It's of critical importance that ice skates to be tightly laced as they naturally loosen during use and the ankle needs firm support for the skater to properly control the skates and to prevent sprained ankles.

The only device that currently helps tie children's ice skates are handles with metal hooks coming out of them like Ice hooks that operate by hooking between the laces and tightens them by pulling the laces from the bottom upward where they cross each other; unfortunately, you use these hooks with a hand, preventing you from tying the laces. The current invention allows the user to hold the child's ice skate down with their feet while tightening and tying the laces with both their hands—which is faster and easier.

SUMMARY

The scope of the present invention is defined solely by the appended claims and detailed description of a preferred embodiment and is not affected to any degree by the statements within this summary. A floor brace for tying children's ice skates is described. The brace threads between the boot and blade of a child's ice skate and allows an adult to stand on either side of the brace holding the skate down while they pull the laces forcefully upward. The brace has an ice skate receiver sized to fit the most common skate blade sizes; alternate embodiments have multiple receivers sized to fit multiple sized skate blade sizes. The brace may also have a skate sharpener and honing stone.

BRIEF DESCRIPTION OF THE DRAWINGS

Various embodiments are described herein with reference to the following Drawings Not all alternatives and options are shown in the Drawings and, therefore, the Claims are not limited in scope to the content of the Drawings.

1. FIGURES

Figure 1:
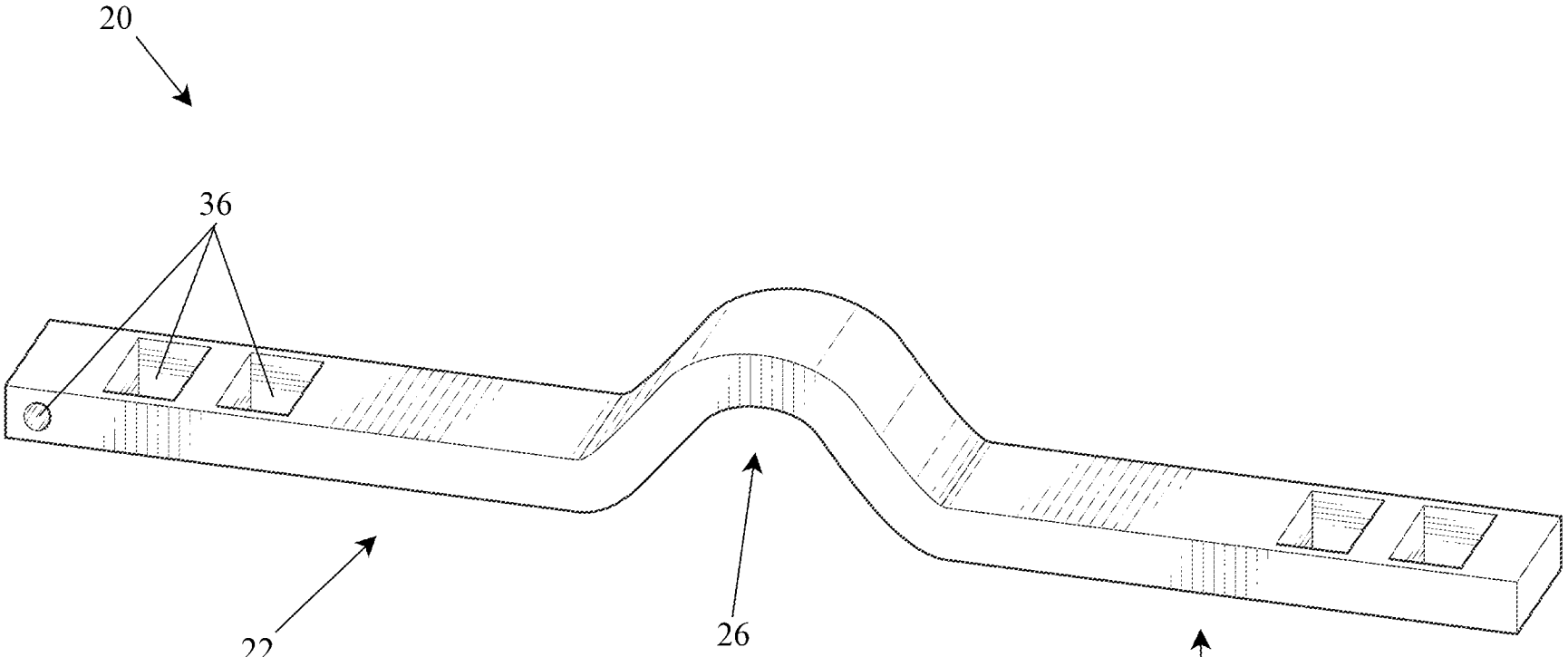

FIG. 1 illustrates a floor brace for tying children's ice skates.

Figure 2:
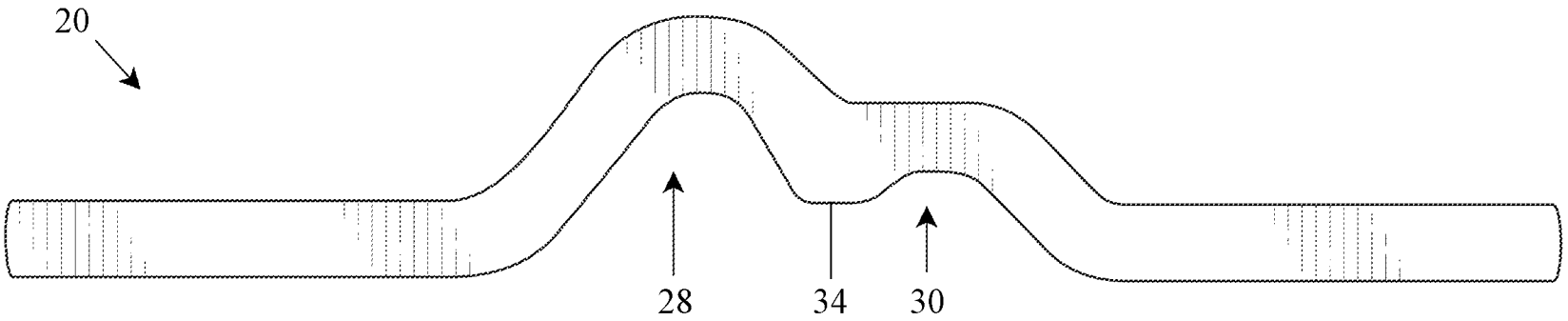

FIG. 2 illustrates a floor brace for tying children's ice skates with two sized notches.

Figure 3:
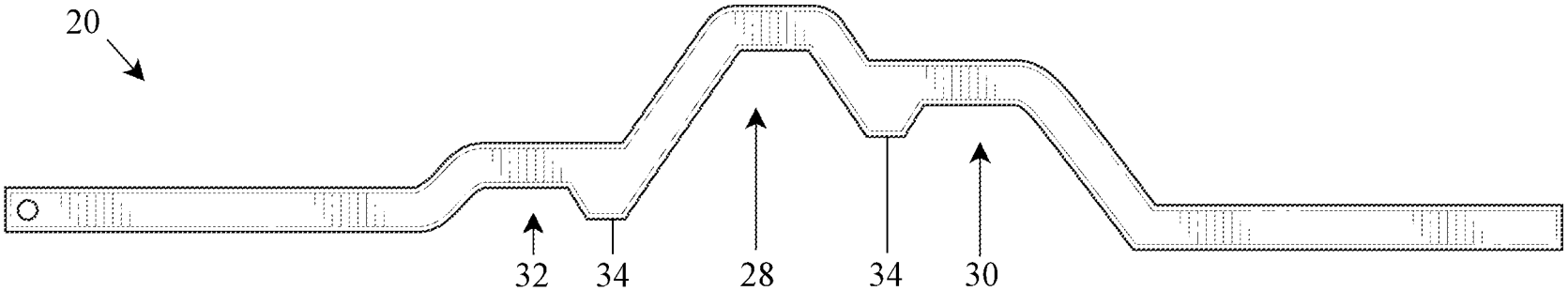

FIG. 3 illustrates a floor brace for tying children's ice skates with three sized notches.

Figure 4:
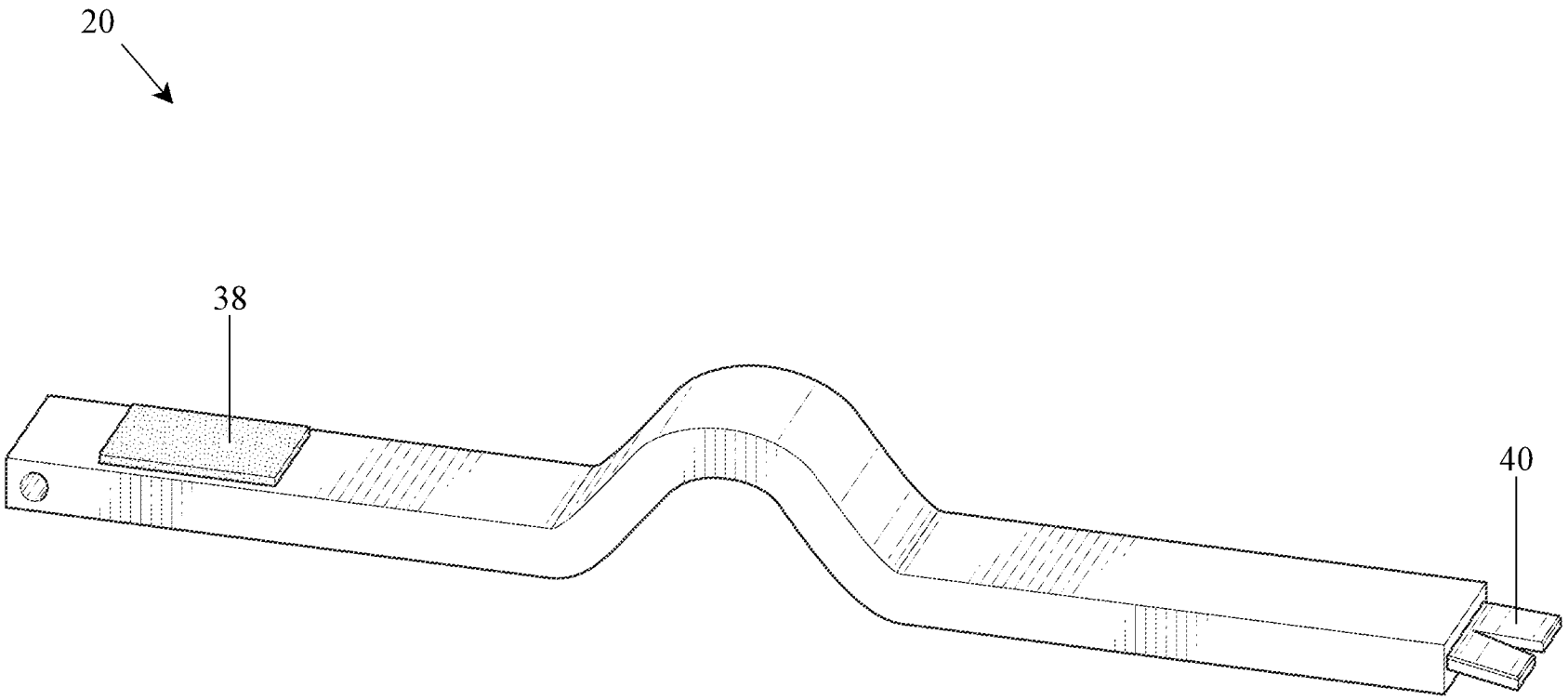

FIG. 4 illustrates a floor brace for tying children's ice skates with ice skate sharpeners.

Corresponding reference characters indicate corresponding components throughout the several figures of the Drawings. Elements in the several figures are illustrated for simplicity and clarity and have not necessarily been drawn to scale.

2. REFERENCES

20 Ice Skate Brace
22 Left-side of Ice Skate Brace
24 Right-side of Ice Skate Brace
26 Ice Skate Blade Receiver
28 First Ice Skate Blade Receiver
30 Second Ice Skate Blade Receiver
32 Third Ice Skate Blade Receiver
34 Notch
36 Hole
38 Honing Stone
40 Ice Skate Sharpener

DETAILED DESCRIPTION

The following description is not to be taken in a limiting sense but is made merely for the purpose of describing the general principles of exemplary embodiments, many additional embodiments of this invention are possible. It is understood that no limitation of the scope of the invention is thereby intended. The scope of the disclosure should be determined with reference to the Claims.

Anybody who has kids that ice skate are aware of the importance and difficulty tying their laces tightly; invariably, their light legs, lack of muscle strength, and short attention span conspire to prevent them from holding their legs down with the force required to counteract the great upward force needed to pull and tie their laces tightly. It's of critical importance that ice skates to be tightly laced as they naturally loosen during use and the ankle needs firm support for the skater to properly control the skates and to prevent sprained ankles For the purposes of promoting an understanding of the principles of the present invention, reference will now be made to the embodiments illustrated in the drawings and specific language will be used to describe the same.

FIG. 1 illustrates one embodiment of an ice skate brace (20). The ice skate brace itself is a: bar, rod, pole, stick, or shaft; the brace can be made of any material suitable for its purpose including plastic, rubber, metal, wood, etc. The brace itself is comprised of three main elements: 1) the left-side of the ice skate brace (22), 2) the right-side of the ice skate brace (24), and 3) an ice skate blade receiver (26). The brace may also have holes (38) for conveniently hanging the brace. As shown, in a preferred embodiment the brace is flat on the bottom side so that the braces ice skate blade receiver bridges over the skate blade to be braced. In a preferred embodiment the brace is about a foot long and 0.75 inches wide and tall.

Functionally, the ice skate floor brace (20) threads between the boot and blade of an ice skate and allows the user to place their feet on top of the left (22) and right-side (24) of the ice skate brace, holding both the brace and the skate firmly on the floor. Once the skate is braced on the floor, the user may pull the laces of the skate forcefully upward without the skate lifting in the air. This function is particularly important with children, but could also be useful with disabled adults, or for anyone who likes particularly tight laces and has someone to assist them in tying their laces.

The ice skate brace (20) has an ice skate blade receiver (26) sized to fit the most common skate blade sizes, including any skate blade holders, without a gap between the brace and the skate when in use. Alternate embodiments have multiple receivers sized to fit multiple sized skate blade sizes. In a preferred embodiment, the ice skate blade receiver (26) has a width of between two and three inches and a height between one and two inches and has a curve to it so that it fits the largest variety of skates. A curve that is elliptical also works particularly well.

FIG. 2 illustrates an embodiment of an ice skate brace (20) that comprises a first ice skate blade receiver (28) and a second ice skate blade receiver (30). The ice skate brace (20) also comprises a notch (34) between the first ice skate blade receiver (28) and a second ice skate blade receiver (30). This embodiment allows the brace to accommodate more precisely two variations of skate sizes. The notch prevents a skate from slipping from a smaller ice skate blade receiver into a larger one.

FIG. 3 illustrates an embodiment of an ice skate brace (20) that comprises a first ice skate blade receiver (28), a second ice skate blade receiver (30), and a third ice skate blade receiver (32). The ice skate brace (20) also comprises two notches (34) between the first ice skate blade receiver (28) and a second ice skate blade receiver (30); and between the second ice skate blade receiver (30) and the third ice skate blade receiver (32). This embodiment allows the brace to accommodate more precisely three variations of skate sizes. The notches prevent a skate from slipping from a smaller ice skate blade receiver into a larger one.

FIG. 4 illustrates an embodiment of an ice skate brace (20) that further comprises a skate sharpener (40) and/or a honing stone (38); thereby combining multiple useful tools for ice skates in one.

Information as herein shown and described in detail is fully capable of attaining the above-described object of the present disclosure, the presently preferred embodiment of the present disclosure; and is, thus, representative of the subject matter; which is broadly contemplated by the present disclosure. The scope of the present disclosure fully encompasses other embodiments which may become obvious to those skilled in the art, and is to be limited, accordingly, by nothing other than the appended claims, wherein any reference to an element being made in the singular is not intended to mean "one and only one" unless explicitly so stated, but rather "one or more." All structural and functional equivalents to the elements of the above-described preferred embodiment and additional embodiments as regarded by those of ordinary skill in the art are hereby expressly incorporated by reference and are intended to be encompassed by the present claims.

Moreover, no requirement exists for a system or method to address each and every problem sought to be resolved by the present disclosure, for such to be encompassed by the present claims. Furthermore, no element, component, or method step in the present disclosure is intended to be dedicated to the public regardless of whether the element, component, or method step is explicitly recited in the claims. However, that various changes and modifications in form, material, work-piece, and fabrication material detail may be made, without departing from the spirit and scope of the present disclosure, as set forth in the appended claims, as may be apparent to those of ordinary skill in the art, are also encompassed by the present disclosure.

What is claimed is:

1. An ice skate brace in the form of a singular rod, bar, pole, stick, or shaft, comprising:

a left side;

a right side; and an ice skate blade receiver fit to receive the height and width of an ice skate blade between said left side and said right side;

wherein when said ice skate brace is threaded through an ice skate above an ice skate blade and below an ice skate boot, said ice skate blade receiver receives the ice skate blade and said left side and said right side lay on the floor;

wherein when a user stands on said left and said right sides of said ice skate brace, said ice skate will be held downward by the user's weight on said ice skate brace.

2. The ice skate brace of claim 1, wherein said ice skate blade receiver has a width of between two and three inches and a height between one and two inches.

3. The ice skate brace of claim 1, wherein said ice skate blade receiver has a width of two inches and a height of 1.5 inches.

4. The ice skate brace of claim 1, wherein said ice skate blade receiver is curved.

5. The ice skate brace of claim 4, wherein said ice skate blade receiver curve is elliptical.

6. The ice skate brace of claim 1, wherein said ice skate blade receiver has a first and second ice skate blade receiver.

7. The ice skate brace of claim 6, further comprising a notch between said first and second ice skate blade receiver.

8. The ice skate brace of claim 1, wherein said ice skate blade receiver has a first, a second ice skate blade receiver, and a third ice skate blade receiver.

9. The ice skate brace of claim 8, further comprising a notch between said first and second ice skate blade receiver and a notch between said second and said third skate blade receiver.

10. The ice skate brace of claim 1, further comprising an ice skate sharpener.

11. The ice skate brace of claim 1, further comprising a honing stone.

12. The ice skate brace of claim 1, further comprising a hole.

13. The ice skate brace of claim 1, wherein said brace is a foot long and 0.75 inches wide and tall.

* * * * *